US005511329A

United States Patent [19]

Mickelson

[11] Patent Number: 5,511,329

[45] Date of Patent: Apr. 30, 1996

[54] BACKHOE MOUNTING MECHANISM

[75] Inventor: Roger D. Mickelson, West Burlington, Iowa

[73] Assignee: Case Corporation, Racine, Wis.

[21] Appl. No.: 367,089

[22] Filed: Dec. 30, 1994

[51] Int. Cl.[6] ..... E02F 3/28; E02F 3/76

[52] U.S. Cl. ..... 37/468; 37/901; 414/723

[58] Field of Search ..... 37/467, 468, 469, 37/901, 902, 903; 172/610, 272, 275; 414/723, 686, 694, 695, 607; 280/150.5, 764

[56] References Cited

U.S. PATENT DOCUMENTS

| | | | |
|---|---|---|---|
| 3,430,790 | 3/1969 | Beltrami | 214/138 |
| 3,997,987 | 12/1976 | Tomlinson | 37/103 |
| 4,013,307 | 3/1977 | Dowd et al. | 280/764 |
| 4,032,015 | 6/1977 | Hemphill | 37/901 X |
| 4,039,095 | 8/1977 | Long | 214/138 D |
| 4,125,199 | 11/1978 | Abels | 214/730 |
| 4,345,872 | 8/1982 | Arnold | 414/723 X |
| 4,360,309 | 11/1982 | Reeves | 414/671 |
| 4,371,307 | 2/1983 | Mattson | 37/901 X |
| 5,024,010 | 6/1991 | Huldén | 37/468 X |
| 5,040,815 | 8/1991 | Evans | 280/425.2 |
| 5,158,420 | 10/1992 | Weyer | 414/694 |
| 5,215,386 | 6/1993 | O'Dwyer | 384/537 |
| 5,400,531 | 3/1995 | Brown | 37/468 |

*Primary Examiner*—Terry Lee Melius
*Assistant Examiner*—Robert Pezzuto
*Attorney, Agent, or Firm*—Rudnick & Wolfe

[57] ABSTRACT

A mechanism for mounting an earthworking implement such as a backhoe apparatus to a mobile frame of an off-highway machine. The mounting mechanism includes a support attachment that is connected to the frame for movement about a generally vertical pivot axis. The earthworking implement is carried by, and thus, movable with the support attachment. First and second drivers move the support attachment and thereby the earthworking implement in opposite directions relative to each other. Each driver has one end articulately connected to the machine frame and a second end connected to the support attachment by a pin aligning a second generally vertical axis that extends generally parallel to the pivot axis of the support attachment. A self-aligning bearing is captively carried by and between the second end and a respective pin of each driver to compensate for vertical misalignment between the first and second vertical axes without substantially increasing the distance the pivot axis is disposed away from the frame.

9 Claims, 2 Drawing Sheets

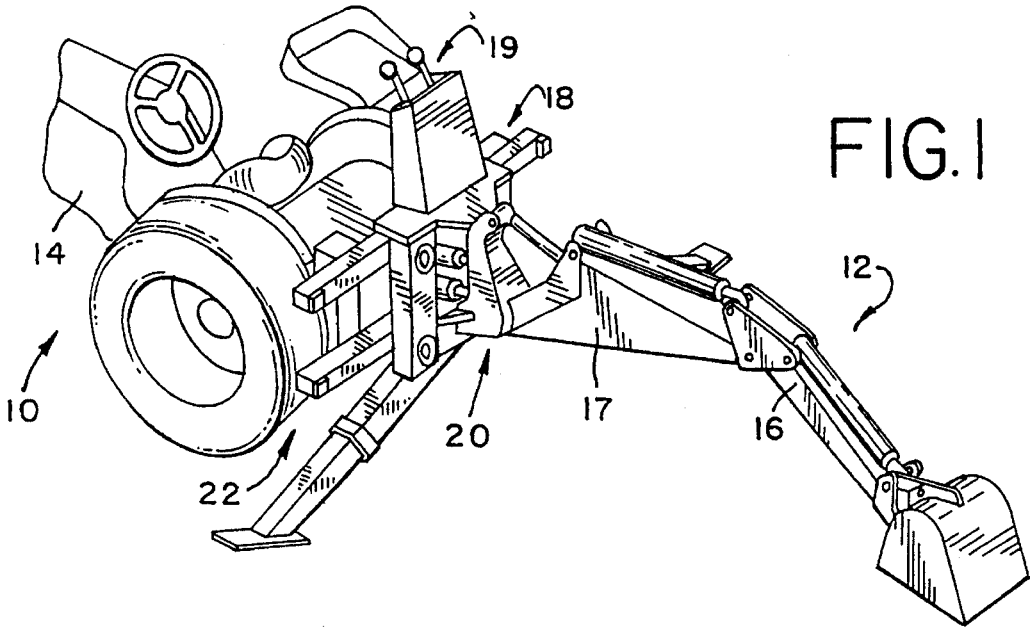
FIG.1
FIG.2
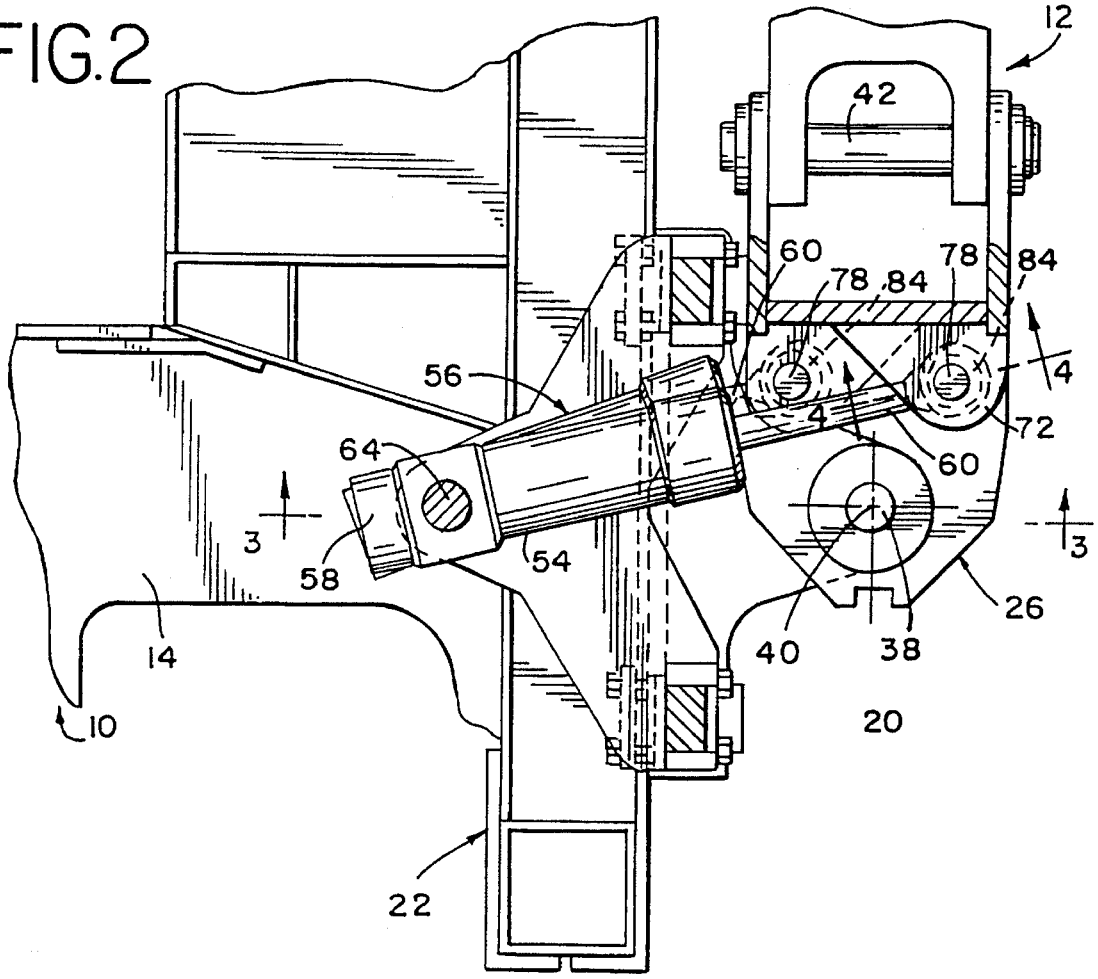

BACKHOE MOUNTING MECHANISM

FIELD OF THE INVENTION

The present invention generally relates to a backhoe apparatus and, more particularly, to a mechanism for mounting a backhoe apparatus to a frame of an implement for swinging movements to opposite sides of the implement.

BACKGROUND OF THE INVENTION

A typical backhoe apparatus includes an elongated boom with a dipper stick assembly articulately connected to the distal end of the boom. A suitable tool such as a bucket or the like is connected to the distal end of the dipper stick assembly. The boom, dipper stick assembly, and tool are relatively massive components that develop substantial inertia as they move from one position to another.

The backhoe apparatus is conventionally mounted to a frame of an off-highway implement by a support apparatus or swing tower. The swing tower allows for generally horizontal movement of the backhoe apparatus to opposite sides of the implement about a generally vertical pivot axis. The generally vertical pivot axis about which the swing tower moves is typically defined by a pair of vertically and axially aligned pins that pass through suitable swing tower bushings. A pair of coacting drivers are typically provided between the implement frame and the swing tower from imparting swinging movements to the swing tower and thereby to the backhoe apparatus. The drivers are typically in the form of linearly extendable/retractable hydraulic cylinders.

As will be appreciated by those skilled in the art, a cylinder end of each hydraulic cylinder is pivotally connected to the implement frame to allow pivotal movement of the drivers in response to movements of the backhoe apparatus to opposite sides of the implement or machine. As is conventional, each hydraulic cylinder has a piston rod that linearly extends from the cylinder end of the driver. The rod end of each cylinder is articulately connected to the swing tower as by a pin passing endwise through a weldment. The pins that connect the rod ends of the cylinders to the swing tower each extend along an axis that is parallel to the vertical swing axis of the swing tower.

To facilitate transportation of the implement, the center of gravity of the backhoe apparatus is disposed as close as possible to the rear end of the implement frame. Thus, the horizontal distance separating the rear end of the implement from the pivot axis of the swing tower is minimized and there are close tolerances and relatively tight space constraints between the implement frame and the swing tower.

Trunion mounted swing cylinders are commonly used to articulately connect the cylinder end of each driver to the implement frame and for imparting swinging movements to the swing tower and thereby to the backhoe apparatus. The trunion mounted swing cylinders improve the geometry of the swing mechanism used to pivotally move the backhoe apparatus to opposite sides of the implement while advantageously producing better swing torque characteristics.

As is well known, a backhoe apparatus is commonly used in an environment laden with dirt, grit, sand and other highly abrasive materials. During operation of the backhoe apparatus, quick reversal of the hydraulic cylinder drivers, that commonly occurs during operation of the backhoe apparatus, coupled with the relatively high inertia forces developed by the components of the backhoe apparatus as it swings from one position to another, imparts extraordinarily high impact forces against all the connections of the backhoe swing mechanism. Understandably, clearances are required in the various swing mechanism components to compensate for various slip fits between the backhoe components, assembly misalignment, and foreseeable misalignment caused by wear between related components. Enhanced wear results between related components due to the environmental dirt, dust and sand in the clearances between the component parts that ultimately results in looser fits than was originally designed.

While offering an advantageous geometric configuration and better swing torque characteristics, trunion mounted cylinders are not tolerant of misalignment between component parts. That is, trunion mounted cylinders only allow for minimum misalignment between the component parts of the swing mechanism due to the relatively short coupling distance between the trunion and the pin used to connect the driver to the swing tower. Moreover, because there is such a short distance separating the swing tower from the implement frame, minor clearances allowed between the component parts of the swing mechanism results in substantially greater overall movement of the backhoe apparatus.

As mentioned above, while a certain degree of clearance between component parts of the swing mechanism is required, other component part misalignments are unavoidable due to human error. Also, the operational environment of the backhoe apparatus tends to cause wear thus resulting in misalignment between component parts of the swing mechanism. Notwithstanding the cause, misalignment between the vertical axis about which the swing tower moves and the axis of the pins used to connect the drivers to the swing tower results in a substantial bending moment being imparted to the pins and the weldments that accommodate the pin and articulately connect the rod end of each cylinder to the swing tower. Because the trunion mounted cylinders are substantially intolerant to misalignment, the fatigue life of the rod weldments or pins can be substantially reduced during operation of the backhoe operation due to the bending stress imparted thereto. The problems associated with a broken backhoe swing cylinder component are substantial.

Thus, there is a need and a desire for a backhoe mounting mechanism which promotes the use of trunion mounted drivers and is nevertheless forgiving of misalignment and cumulative tolerances required and inherent with such, mounting mechanisms for a backhoe apparatus.

SUMMARY OF THE INVENTION

In view of the above, and in accordance with the present invention, there is provided an improved mechanism for mounting a backhoe assembly including a material handling unit to a frame of an off-highway implement. The mounting apparatus includes a swing tower that mounts the backhoe apparatus to the implement frame for pivotal movement about a first generally vertical pivot axis. The swing tower has the material handling unit connected thereto. First and second drivers pivotally move the swing tower and thereby the material handling unit in opposite directions about the first pivot axis. A first end of each driver is connected to the implement frame. A second end of each driver is articulately connected to the swing tower by a pin defining a second generally vertical axis that extends generally parallel to the first pivot axis. A self-aligning bearing is captively carded by and between the second end and a respective pivot pin of each driver to compensate for vertical misalignment between the first and second vertical pivot axes of the swing tower and pivot pin.

In a preferred form of the invention, each driver includes a linearly extendable/retractable hydraulic cylinder. In the illustrated embodiment, a cylinder end of each driver is articulately connected to the frame. A piston rod linearly extends from the cylinder end and the rod end of the cylinder is articulately connected to the swing tower.

With the present invention, the cylinder end of each driver is connected to the implement frame with a trunion thereby advantageously providing better swing torque characteristics while concurrently improving the geometry of the mounting mechanism. The trunion mounted cylinders also allow for a shorter coupling effective thus minimizing the effect the backhoe apparatus has on the center of gravity of the implement to which it is connected. In a preferred from of the invention, each trunion mounted cylinder is captively accommodated between two vertically spaced and apertured mounting plates that are secured to and extend from the implement frame.

The self-aligning bearing on each driver compensates for misalignment between the vertical pivot axis about which the swing tower moves and the vertical axis of the pin that connects the respective driver to the swing tower. In a most preferred form of the invention, the self-aligning bearing comprises a spherical bearing that minimizes "free play" between the pivotal connections of the backhoe apparatus by allowing tighter tolerances between the connecting pin, the bearing, and the rod end of the respective cylinder while still allowing for future misalignment conditions. Moreover, the self-aligning bearings compensate for misalignment without significantly increasing the linear distance between the trunion and the pin connection of the driver to the swing tower.

These and other advantageous features and objectives of the present invention will be come readily apparent from the following detailed description, the appended claims, and the following drawings.

BRIEF DESCRIPTION OF THE DRAWINGS

FIG. 1 is a fragmentary perspective view of an off-highway implement having a backhoe apparatus mounted thereto;

FIG. 2 is a plan view, partial in section, of a swing mechanism for mounting the backhoe/apparatus to frame of the off-highway implement shown in the FIG. 1;

DETAILED DESCRIPTION OF THE PRESENT INVENTION

Figure 3:
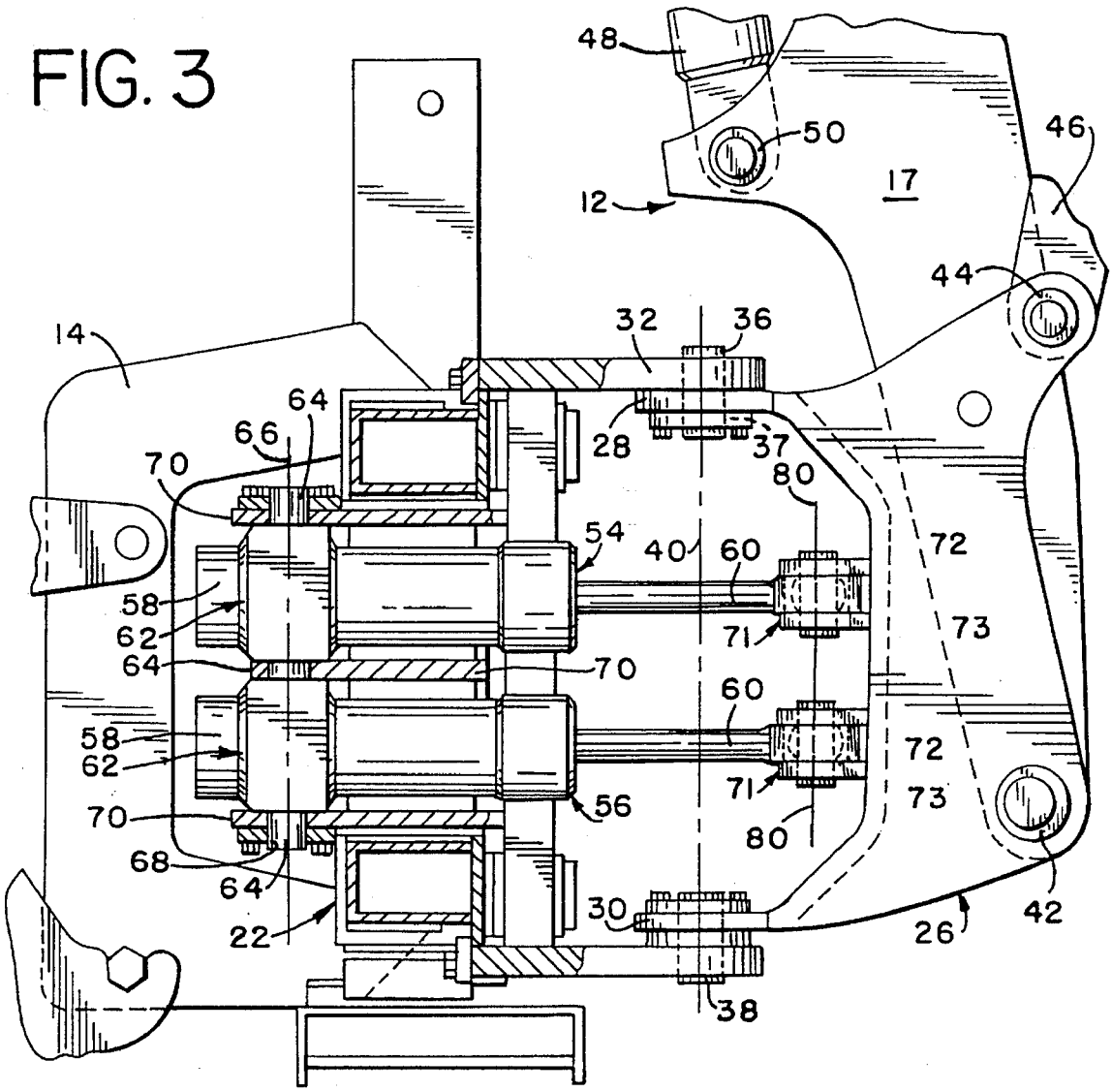
FIG. 3 is a partial sectional view taken along line 3—3 of FIG. 2.

While the present invention is susceptible of embodiment in various forms, there is shown in the drawings and will hereinafter be described a preferred embodiment of the invention with the understanding that the present disclosure is to be considered as setting forth an exemplification of the invention which is not intended to limit the invention to the specific embodiment illustrated.

Referring now to the drawings, wherein like reference numerals refer to like parts through those several views, there is shown an off-highway implement, generally designated by reference numeral 10, having a backhoe apparatus, generally indicated by reference numeral 12, attached thereto. Suffice it to say, implement 10 includes a fore-and-aft extending frame 14 that is suitably supported for movement across a field. The backhoe apparatus 12 typically includes a material handling unit 16 including a vertically elongated boom structure 17. In the illustrated form of the invention, an operator station 18 is located toward the rear end of the implement where an operator or operating engineer sits to manipulate a set of controls 19 for influencing movement of the backhoe apparatus 12.

According to the present invention, a swing mechanism 20 is provided for mounting the backhoe apparatus 12 preferably to a rear end of the frame 14 of implement 10. In FIGS. 1 and 2, the swing mechanism 20 is shown connected to a horizontal slide frame assembly 22 that allows side shifting movements of the backhoe apparatus 12. It should be appreciated, however, that the slide frame assembly 22 forms no part of the present invention. It should further be appreciated that the swing mechanism 20 for mounting the backhoe apparatus 12 to the implement frame is equally applicable to a backhoe apparatus 12 that is mounted directly to the frame 14 of the implement 10 other than through a slide frame assembly 22.

As shown in FIG. 3, the swing mechanism 20 of the present invention includes. a support attachment in the form of a swing tower 26 that has a generally C-shaped configuration. The swing tower 26 is provided with upper and lower vertically spaced mounting flanges 28 and 30 that cooperate with mounting brackets 32 and 34 projecting rearwardly from the frame 14 of the implement 10. Upper and lower axially aligned pivot pins 36 and 38 pass through swing tower bushings 37 and 39, respectively, to pivotally join the swing tower 26 to the implement frame 14 and collectively define a generally vertical pivot axis 40 about which the swing tower and thereby the backhoe apparatus moves.

In the embodiment of the invention illustrated in FIG. 3, the swing tower 26 carries a bottom horizontal pivot shaft 42 for pivotally mounting the boom 17 of the backhoe apparatus 12 to the swing tower 26. Also, the swing tower 26 is provided with an upper horizontal pivot shaft 44 for pivotally mounting a boom hydraulic actuator or boom cylinder 46 which is preferable of a double acting type. A dipper stick cylinder 48, also of a double acting type, is mounted on a pivot shaft 50 carried on the boom 17.

The swing tower 26 and thereby the backhoe apparatus 12 is moved or swung about axis 40 by a pair of drivers 54 and 56 that are mounted in a manner minimizing the distance separating the pivot axis 40 from the implement frame 14 thus advantageously locating the center of gravity for the earth working implement 12 as close as possible to the rear of the implement frame 14. In a most preferred form of the invention, the drivers 54, 56 are substantially identical to each other and comprise a pair of double acting linearly extendable/retractable hydraulic cylinders that are powered from a suitable hydraulic power source (not shown) carried on the implement frame 14 and that are operated in response to manipulation of the controls 19 (FIG. 1). Each hydraulic cylinder or driver 54, 56 includes a cylinder end 58 and a rod end 60 that linearly extends from the cylinder end 58.

The cylinder end of each driver 54, 56 is pivotally connected to the frame 14 of the implement 10. In the illustrations, the drivers 54, 56 are shown connected to the implement frame 14 in vertically spaced relation relative to each other and are commonly arranged to have the centerline of each cylinder on opposite sides of the pivot axis 40 about which the backhoe apparatus 12 moves or pivots. It should be appreciated, however, that the drivers 54, 56 could be connected to the implement frame 14 in a vertical position as shown in FIG. 5, or mounted side by side in a horizontal position without detracting or departing from the spirit and scope of the present invention.

To improve the geometry of the swing mechanism 20 and to enhance the swing torque characteristics thereof, the cylinder end 58 of each hydraulic cylinder or driver 54, 56 has a trunion mounting bracket 62 secured thereto. Although the trunion mounting bracket 62 in the illustrated embodiment of the invention is shown toward a rear end of the respective driver, it will be appreciated that the trunion mounting bracket 62 can be secured anywhere along the length of the cylinder end of the respective driver without detracting or departing from the spirit and scope of the present invention. Suffice it to say, each trunion mounting bracket 62 includes a pair of diametrically opposed trunions 64 that extend radially outward away from the cylinder end 58 of the respective driver and defines a pivot axis 66 that permits articulate movement of the respective driver when swinging movement is imparted to the earth working implement 12. Each trunion 64 is accommodated for pivotal or turning movement in openings 68 preferably defined by rigid and generally horizontal mounting plates 70 that radially extend outwardly from the implement frame 14.

Figure 4:
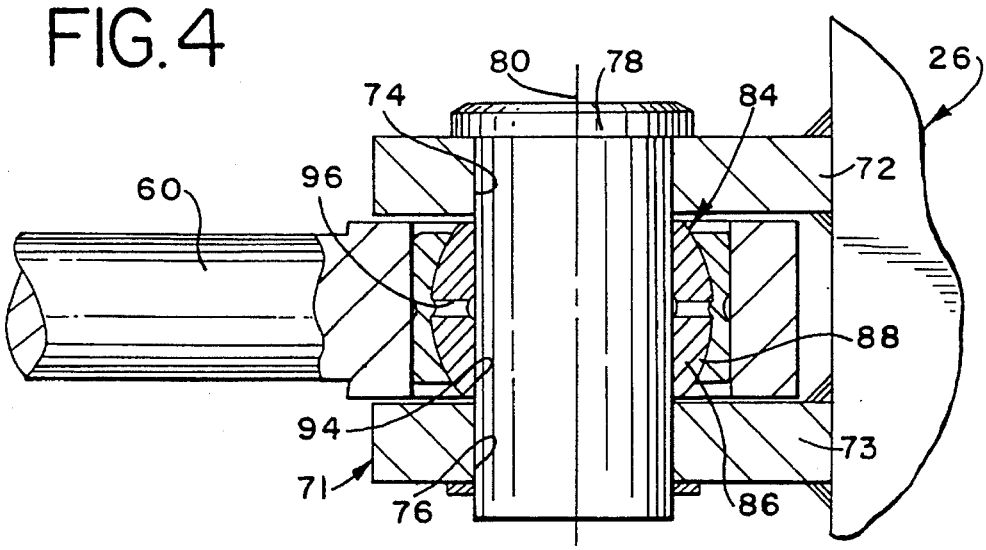
FIG. 4 is an enlarged cross-sectional view taken along line 4—4 of FIG. 2.

The rod end 60 of each driver or cylinder 54, 56 is pivotally or articulately connected to the swing tower 26 of the swing mechanism 20 preferably by a weldment 71. As shown, weldment 71 is comprised of a pair of vertically spaced brackets 72 and 73 that are fixedly attached and rigidly extend from the swing tower 26 to captively accommodate the rod end 60 of a respective driver therebetween. In the illustrated form of the invention, and as is conventional, brackets 72, 73 are welded or cast into the swing tower 26. As best seen in FIG. 4, the brackets 72 and 73 define axially aligned holes or openings 74 and 76, respectively, that are configured to receive a pin 78 which, in combination with the openings 74 and 76, define a vertical axis 80 that extends generally parallel to the generally vertical pivot axis 40 (FIG. 3) about which the swing tower 26 and backhoe apparatus 12 move. To inhibit pin 78 from inadvertently becoming dislodged from its loose passage through the vertically aligned holes 74, 76, each pin 78 is releasably secured to a respective weldment with a bolt, a snap ring or otherwise sectored in place.

To promote extended operation of the swing mechanism 20, a self-aligning bearing 84 is captively carried by and between the piston rod 60 of each driver and the pin 78 that connects the respective driver to the swing tower 26. As illustrated in FIG. 4, bearing 84 preferably includes a spherical race 86 that is snugly accommodated within a socket 88 provided at the piston end 60 of each driver.

Preferably, the minimum outside diameter of bearing or race 86 is greater than the maximum diameter of the apertures 74, 76 in the mounting brackets 72 and 73, respectively, that captively hold the rod end 60 of each driver therebetween. Moreover, the spherical race 86 defines a through bore 94 having a diameter that is sized to snugly fit about the outside diameter of the pin 78 passing therethrough. In a preferred form of the invention, the spherical race 86 defines lubricant channels or passages 96 that open at one end to the bore 94 and open at the opposite end to the socket 88 provided at the piston end 60 of the respective driver.

The swing mechanism 20 of the present invention is configured to maintain the swing axis 40 of the backhoe apparatus 12 as close as possible to the frame 14 of the implement 10 without detracting from the effective and efficient operation of the backhoe apparatus 12. Towards these ends, each driver 54, 56 associated with the swing mechanism is connected to the implement frame 14 by the trunion mounting brackets 62. Using the trunion mounted brackets 62 to mount the drivers 54 and 56 to the frame 14 improves the geometry of the swing mechanism and enhances the swing torque characteristics of the swing mechanism. That is, using the trunion mounted bracket 62 to secure the drivers 54, 56 to the implement frame 14 minimizes the distance separating the pivot axis 66 of the drivers 54, 56 relative to the swing axis 40.

As disclosed above, the trunion mounted bracket 62 comprise a plurality of vertically spaced mounting plates 70 that vertically aligned holes 68 for accommodating the trunions 64 at the cylinder end of each driver. As will be appreciated by those skilled in the art, the mounting plates 70 form a fabricated pan of the swing mechanism. Typically, one of the mounting plates 70 is welded in place while the other mounting plate is bolted in place. Accordingly, there is a possibility for human error and, thus, the holes 68 in the mounting plates 70 may be slightly misaligned in a vertical direction relative to each other for each swing mechanism that is produced.

In the illustrated form of the invention, the piston rod end 60 of each driver 54, 56 is captively arranged between the vertically spaced brackets 72 and 73 of weldment 71. Typically, the brackets 72, 73 are welded or cast into the swing tower 26. Thus, and as with the mounting brackets 70 on the frame 14 of the implement, there is a possibility that the holes 74, 76 in the brackets 72, 73, respectively will not be in perfect vertical alignment to each other or to axis 40. This is due to human error which is unavoidable.

While offering significant operational advantages to the backhoe apparatus, trunion mounted drivers have the characteristic of only allowing for minimum misalignment between the pins 78 and the axis 66 about which the trunions turn due to the short coupling effect inherent in such designs and the rigid connection the trunions create. As will be appreciated, clearances in the various related component parts comprising the swing mechanism 20 are required to compensate for fits, some assembly misalignment, and to compensate for future misalignment caused by wear of the related components. As will be appreciated, however, due to the geometry of the swing mechanism 20 and the short coupling effect of the cylinders 54, 56, minor clearances between the various related components of the swing mechanism results in a substantially greater movement of the backhoe apparatus. Also, misalignment between the vertical axis 80 of the pin 78, the swing axis 40 about which the swing tower moves, and the pivot axis 66 for the cylinders adds increased loading on the swing cylinder assemblies and can impart substantial bending moments to the pins 78 used to connect the drivers 54, 56 to the swing tower 26.

With the present invention, the self-aligning bearing 84 carded by and between the rod end 60 and a respective pin 78 of each driver 54, 56 compensates for angular misalignment between axis 80 of pin 78 and the swing axis 40 of the swing tower. Notably, the self-aligning bearing 84, fitted about each pin 78, does not significantly increase the distance separating the frame 14 from the pivot axis 40 thereby improving operation of the swing mechanism 20 without effecting the center of gravity of the backhoe apparatus 12. Moreover, the spherical design of the bearing 84 can minimize the "free play" of the backhoe apparatus 12 by allowing significantly tighter fits between the pin 78, the bearing 84 and the cylinder rod end 60 of each driver 54, 56 while still allowing for existing and future misalignment conditions between pivot axis 40 of the swing mechanism 20 and the vertical axis of the pins 78. Accordingly, the bending moments imparted to the pins 78 are significantly reduced thereby prolonging the useful life of the swing mechanism 20.

From the foregoing, it will be observed that numerous modifications and variations can be effected without departing from the true spirit and scope of the novel concept of the present invention. It will be appreciated that the present disclosure is intended as an exemplification of the invention, and is not intended to limit the invention to the specific embodiment illustrated. The disclosure is intended to cover by the appended claims all such modifications as fall within the scope of the claims.

What is claimed is:

1. A mechanism for mounting a backhoe assembly including a material handling unit to an off-highway implement having a movable frame, said mounting mechanism comprising:

a support attachment for mounting said backhoe assembly to the implement frame for pivotal movement about a first generally vertical pivot axis, said support attachment having said material handling unit connected thereto; and first and second drivers for moving said support attachment in opposite directions about said axis, each driver having a first end articulately connected to said frame and a second end connected to said support attachment by a pin defining a second generally vertical axis that extends generally parallel to said first vertical pivot axis, and wherein a self-aligning bearing is captively carried by and between said second end and a respective pin of each driver to compensate for vertical misalignment between said first and second vertical axes of the support attachment and pin.

2. The mounting mechanism according to claim 1 wherein each pin used to connect the second end of the respective driver to the support attachment passes through apertured brackets connected to and extending from said support attachment.

3. The mounting mechanism according to claim 1 wherein said support attachment is mounted to the implement frame by at least two vertically aligned pivot pins that define the vertical axis about which said support attachment moves.

4. A mechanism for mounting a material handling unit to an earthworking implement including a fore-and-aft extending frame, said mounting mechanism permitting controlled swinging movements of said material handling unit to opposite sides of said frame, said mounting mechanism comprising:

a swing tower having said material handling member movably connected thereto, said swing tower being rotatably attached to said frame for movement in opposite directions about a first generally vertical pivot axis; and at least two double acting linearly extendable and retractable hydraulic cylinders connected between said implement frame and said swing tower for controlling the position of the swing tower and the material moving member relative to said frame, each hydraulic cylinder having a cylinder end that is articulately connected to the implement frame and a piston rod end that extends linearly from the cylinder end, a pin for articulately interconnecting a portion of said swing tower to the rod end of a respective hydraulic cylinder, said pin being vertically disposed and defining a generally vertical axis extending generally parallel to the vertical pivot axis about which the swing tower moves, and a spherical bearing captively carried by and between said piston rod end of each cylinder and a respective pin to compensate for vertical misalignment between the pivot axis about which said swing moves and the axis defined by said vertical pin thereby reducing the bending forces imparted to the respective pins upon swinging movement of the swing tower.

5. The mounting mechanism according to claim 4 wherein said swing tower includes at least two pairs of vertically spaced mounting plates extending rearwardly from the swing tower, each pair of mounting plates capturing a rod end of one of the hydraulic cylinders therebetween, and wherein each pair of mounting plates define two vertically aligned apertures through which said pin passes to interconnect the rod end of a respective hydraulic cylinder to the swing tower.

6. The mounting mechanism according to claim 4 wherein the cylinder end of each hydraulic cylinder is connected to said implement frame for pivotal movement about a fixed vertical axis spaced to a side of said generally vertical pivot axis opposite from the pin used to connect the rod end to the swing tower.

7. The mounting mechanism according to claim 4 wherein said implement frame includes vertically spaced plates that extend horizontally and radially therefrom for pivotally mounting the cylinder ends of said hydraulic cylinders therebetween.

8. The mounting mechanism according to claim 4 wherein a pair of vertically and axially aligned pivot pins define the vertical pivot axis of the swing tower.

9. A mechanism for mounting an earthworking implement including an elongated boom structure to a rear end of a machine having a fore-and-aft extending frame that is supported for movement over a field, said mounting mechanism comprising:

a swing tower having upper and lower portions pivotally mounted on the rear end of said frame for movement about a first generally vertical pivot axis defined by a pair of axially aligned and vertically spaced pivot pins that pass through said upper and lower portions of the swing tower; and two double acting linearly extendable and retractable hydraulic cylinders mounted between said frame and said swing tower within limited space constraints for imparting sideways movement about said vertical pivot axis to the swing tower and thereby to the boom structure carded thereon, with a cylinder end of each hydraulic cylinder being connected to the implement frame on one side of the vertical pivot axis by a trunion mounting that offers improved swing torque characteristics to the mounting mechanism within limited space constraints, and with a rod end of each hydraulic cylinder being connected to the swing tower by a vertical pin defining a vertical axis disposed on an opposite side of the vertical pivot axis about which said swing tower moves, and wherein a spherical bearing is captively carried at and between the rod end of each hydraulic cylinder and the respective pin that connects the rod end to the swing tower to compensate for vertical misalignment between the vertical pivot axis of the swing tower and the vertical axis of each pin thereby reducing bending moments imparted to the pin during swinging movements of the swing tower and boom without significantly increasing the distance separating the vertical pivot axis from the rear end of the implement frame.

* * * * *